US005799774A

United States Patent [19]

Dengel

[11] Patent Number: 5,799,774

[45] Date of Patent: Sep. 1, 1998

[54] WALLET KEY HOLDER

[76] Inventor: Donald F. Dengel, 190 E. Division St., Fond Du Lac, Wis. 54935-4369

[21] Appl. No.: 955,120

[22] Filed: Oct. 21, 1997

[51] Int. Cl.[6] ..... A45C 11/18; A45C 11/32

[52] U.S. Cl. ..... 206/38.1; 206/37.4; 206/37.1; 150/147

[58] Field of Search ..... 150/106, 130–133, 150/147; 70/456 R; 206/37.1, 37.4, 38.1

[56] References Cited

U.S. PATENT DOCUMENTS

| | | | |
|---|---|---|---|
| 779,742 | 1/1905 | Schultze | 150/147 X |
| 1,545,577 | 7/1925 | Arms | 150/147 |
| 1,877,909 | 9/1932 | L'Enfant | 206/37.4 |
| 1,877,910 | 9/1932 | L'Enfant | 206/37.4 |
| 1,877,911 | 9/1932 | L'Enfant | 206/37.4 |
| 2,172,883 | 9/1939 | Wege | 206/38.1 |
| 2,435,032 | 1/1948 | Campbell | 206/38.1 |
| 2,605,802 | 8/1952 | Baldwin | 206/37.4 |
| 4,037,716 | 7/1977 | Marks | 206/37.1 X |
| 4,286,641 | 9/1981 | Watson | 206/37.4 |
| 4,331,194 | 5/1982 | Lederer | 206/37.4 |
| 4,785,645 | 11/1988 | Dengel | 70/45 GR |
| 4,796,750 | 1/1989 | Ingraham | 150/147 X |
| 4,901,549 | 2/1990 | Dengel | 70/45 GR |
| 5,653,332 | 8/1997 | DeWitt, Jr. | 150/147 X |

FOREIGN PATENT DOCUMENTS

| | | | |
|---|---|---|---|
| 1267113 | 3/1990 | Canada | 206/37.4 |
| 1266751 | 6/1961 | France | 206/37.1 |
| 1459254 | 10/1966 | France | 150/147 |
| 2686490 | 7/1993 | France | 150/147 |
| 449082 | 6/1936 | United Kingdom | 150/132 |
| 2214066 | 8/1989 | United Kingdom | 206/37.4 |

*Primary Examiner*—Sue A. Weaver
*Attorney, Agent, or Firm*—William D. Stokes

[57] ABSTRACT

A wallet key holder has a main pocket for holding cards and a plurality of key holding and card holding pockets foldably connected to opposite end portions and to a side portion of the main pocket and communicating with the main pocket. An elongated slit is provided in the main pocket to provide an opening for insertion of not only cards into the main pocket, but also keys into the key holding pockets.

8 Claims, 1 Drawing Sheet

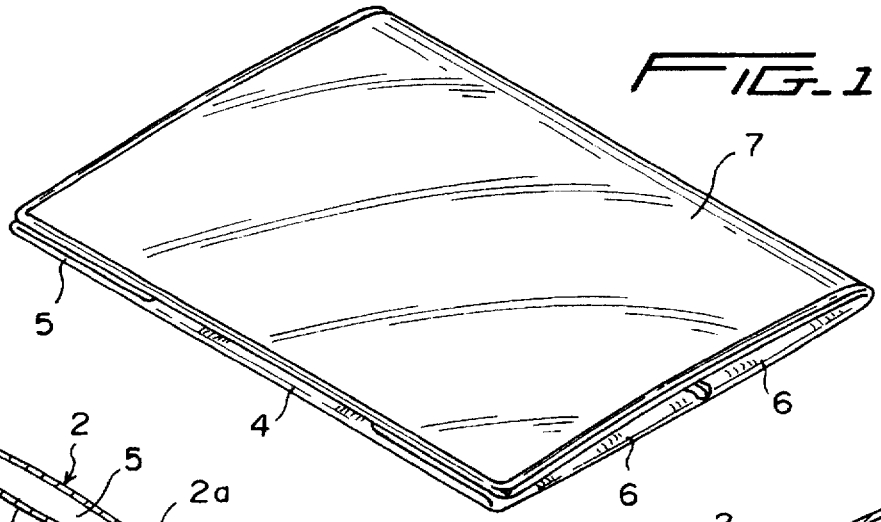
FIG. 1
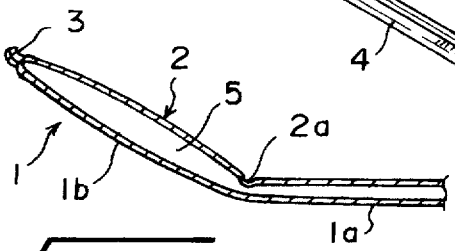
FIG. 4
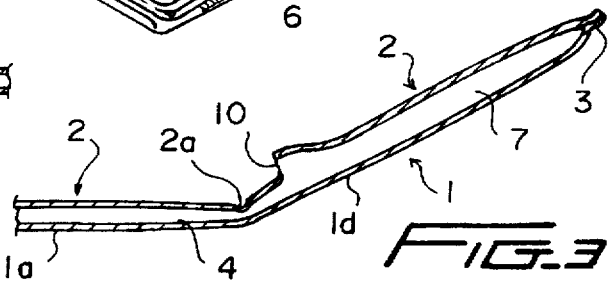
FIG. 3
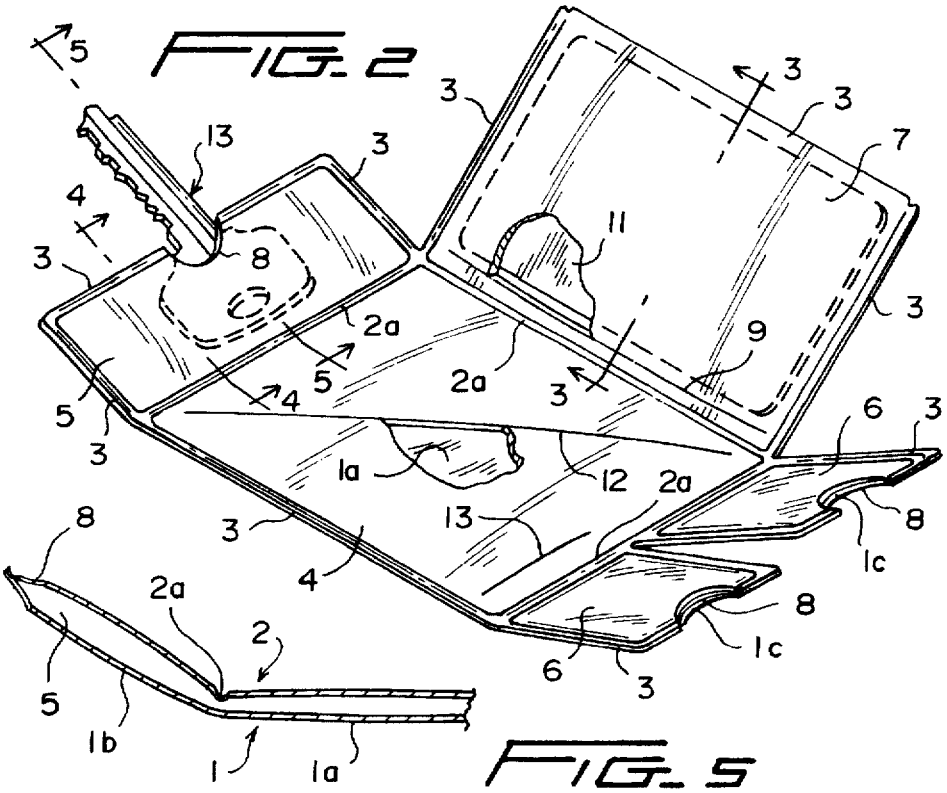
FIG. 2
FIG. 5

WALLET KEY HOLDER

BACKGROUND OF THE INVENTION

Various key holders have been proposed wherein a plurality of pockets are hingedly connected to a body portion of the holder, and a slot is provided in the bottom of each pocket through which the shank of a key extends. In use, the key carrying pockets are adapted to be folded inwardly to a stored position within the holder, and outwardly therefrom when a selected key is to be inserted into a lock.

In an improvement over the above-noted key holders wherein the key shank always extends outwardly from the pocket, applicant's U.S. No. Pat. 4,785,645 dated Nov. 22, 1988 and 4,901,549 dated Feb. 20, 1990 disclose a key holder or retainer wherein the key is slidably mounted in the pocket, whereby a user can slide the key inwardly of the pocket to a stored position wherein the shank of the key is positioned in the pocket, or outwardly of the pocket to an operative position wherein the shank of the key is positioned outwardly of the pocket.

In his continuing research and development of key retainers, applicant has now extended his expertise to a combined wallet and key holder, constructed and arranged to facilitate not only the insertion of keys into the key retainer portion of the holder but also the insertion of credit cards, driver permit, money, etc. into the wallet portion of the holder.

SUMMARY OF THE INVENTION

The wallet key holder of the present invention comprises, essentially, a plastic laminate construction having a substrate and a superimposed layer spaced from the substrate and heat sealed along selected peripheral edges to form pockets. The thickness of the superimposed layer is reduced at selected areas to form fold lines, whereby certain pockets can be folded inwardly to a stored position against a main pocket. An elongated slit is provided in the superimposed layer of the main pocket through which keys can be inserted into certain pockets, and cards, bills, and the like can be inserted into the main pocket.

By this construction and arrangement, an improved inexpensive wallet key holder is provided, whereby keys, cards, and bills are easily insertable therein, and the wallet key holder is foldable to form a compact unit for carrying in a user's pocket.

BRIEF DESCRIPTION OF THE DRAWINGS

FIG. 1 is a perspective view of the wallet key holder of the present invention in the folded position;

FIG. 2 is a perspective view of the key holder of the present invention in the open position;

FIG. 3 is a view taken along line 3—3 of FIG. 2;

FIG. 4 is a view taken along line 4—4 of FIG. 2; and

FIG. 5 is a view taken along line 5—5 of FIG. 2.

DESCRIPTION OF THE PREFERRED EMBODIMENTS

Referring to the drawings and, more particularly, to FIGS. 2, 3, and 4, the wallet key holder of the present invention comprises a rectangular, plastic substrate 1 having a main body portion 1*a*, an extended portion 1*b* on one end thereof, a pair of extended portions 1*c* on the opposite end thereof, and an extended portion 1*d* on a side thereof. A plastic layer 2 having the same configuration as the substrate 1 is superimposed on the substrate 1 and spaced therefrom. The peripheral edges of the substrate 1 and layer 2 are heat sealed as at 3, to thereby form a main pocket 4, a key carrying pocket 5 at one end of the main pocket 4, a pair of key carrying pockets 6 at the opposite end of the main pocket 4, and a card carrying pocket 7 on one side of the main pocket 4. Each of the key carrying pockets 5 and 6 is provided with an arcuate slot 8 on the edge thereof to provide an opening into the pocket through which the shank of a key is adapted to extend. A slit 9 is cut in the layer 2 of pocket 7 to provide an opening 10 to facilitate the insertion of a card 11 into the pocket 7. Similarly, an elongated diagonal slit 12 is cut in layer 2 of main pocket 4 to provide an opening for the insertion of cards, bills, and the like into the main pocket 4. The elongated slit 12 also provides an opening for the insertion of a key 13 into pocket 5, as well as other keys into pockets 6. Thus, the elongated slit 12 performs the dual function of providing not only an access to the main pocket 4 for cards, bills, etc., but also access to pockets 3 and 6 for keys. If desired, another slit 13 can be provided in the layer 2 of the main pocket 4 in proximity to one of the pockets 6 to provide access to the pocket for insertion of a key therein.

To complete the structural description of the wallet key holder of the present invention, the thickness of the layer 2 is reduced as at 2*a* along the peripheral edges of the main pocket 4 adjacent pockets 5, 6, and 7 to facilitate the folding of the pockets 5, 6, and 7 inwardly against the main pocket 4 as shown in FIG. 1.

From the above description, it will be appreciated by those skilled in the art that the wallet key holder of the present invention is an improvement on prior wallet key holders in that, by its construction and arrangement, it is inexpensive to manufacture, it is compact, and the insertion of cards, bills, and keys is facilitated.

It is to be understood that the form of the invention herewith shown and described is to be taken as a preferred example of the same, and that various changes in the shape, size, and arrangement of parts may be resorted to, without departing from, the spirit of the invention or scope of the subjoined claims.

I claim:

1. A wallet key holder comprising a substrate having a peripheral edge, superimposed layer having a peripheral edge, and configuration corresponding to said substrate, said superimposed layer being spaced from said substrate, means for securing the peripheral edge of said superimposed layer to the peripheral edge of said substrate, to thereby provide a main pocket and at least one other pocket communicating and integral with said main pocket, and adapted to receive a key having a shank, a slot provided in a peripheral edge of said other pocket, the shank of said key adapted to extend through said slot outwardly from said other pocket, an elongated slit in said superimposed layer to provide an opening to said main pocket to facilitate not only the insertion of cards into said main pocket, but also the key into said other pocket.

2. A wallet key holder according to claim 1, wherein a fold line is provided between the main pocket and the other pocket, whereby the other pocket can be folded inwardly on top of said main pocket.

3. A wallet key holder according to claim 2, wherein the fold line comprises a line of reduced thickness in said superimposed layer.

4. A wallet key holder according to claim 1, wherein the substrate and superimposed layer are plastic, and the peripheral edges are heat sealed.

5. A wallet key holder according to claim 1, wherein the main pocket is rectangular, said other pocket being positioned on one end of said main pocket, a pair of pockets being integral with and positioned on the opposite end of said main pocket and communicating therewith, said pair of pockets adapted to receive keys having shanks, slots provided in peripheral edges of said pair of pockets through which the key shanks are adapted to extend, said keys being insertable through said opening in said main pocket for insertion into said pair of pockets.

6. A wallet key holder according to claim 5 wherein a fold line is provided between the main pocket and said pair of pockets, whereby the pair of pockets can be folded inwardly on top of said main pocket.

7. A wallet key holder according to claim 1, wherein the main pocket is rectangular, another rectangular pocket positioned on the side of said main pocket and being integral therewith, a slit in the superimposed layer providing an opening into said another rectangular pocket for insertion of cards into said another rectangular pocket.

8. A wallet key holder, according to claim 7, wherein a fold line is provided between the main pocket and said another rectangular pocket, whereby the said another pocket can be folded inwardly on top of said main pocket.

* * * * *